US011751664B2

(12) United States Patent
Givord

(10) Patent No.: US 11,751,664 B2
(45) Date of Patent: Sep. 12, 2023

(54) STENCIL FOR THE APPLICATION OF EYELINER IN ORDER TO FORM A WING OF EYELINER AT THE OUTER CORNER OF AN EYE

(71) Applicant: L'OREAL, Paris (FR)

(72) Inventor: Bertrand Givord, Clichy (FR)

(73) Assignee: L'OREAL, Paris (FR)

( * ) Notice: Subject to any disclaimer, the term of this patent is extended or adjusted under 35 U.S.C. 154(b) by 253 days.

(21) Appl. No.: 15/733,987

(22) PCT Filed: May 16, 2019

(86) PCT No.: PCT/EP2019/062698
§ 371 (c)(1),
(2) Date: Dec. 1, 2020

(87) PCT Pub. No.: WO2020/001853
PCT Pub. Date: Jan. 2, 2020

(65) Prior Publication Data

US 2021/0212441 A1 Jul. 15, 2021

(30) Foreign Application Priority Data

Jun. 27, 2018 (FR) ..... 18 55803
Jun. 27, 2018 (FR) ..... 18 55804
Jun. 27, 2018 (FR) ..... 18 55806

(51) Int. Cl.
*A45D 40/30* (2006.01)
*A45D 40/20* (2006.01)

(52) U.S. Cl.
CPC ..... *A45D 40/20* (2013.01); *A45D 40/30* (2013.01); *A45D 2040/204* (2013.01); *A45D 2200/1072* (2013.01)

(58) Field of Classification Search
CPC ..... A45D 40/30; A45D 2040/201; A45D 44/002; A45D 44/12; A45D 40/20; A45D 2200/1072; A45D 2200/05–058
(Continued)

(56) References Cited

U.S. PATENT DOCUMENTS 3,485,251 A * 12/1969 Louise ..... A45D 40/30 132/216
4,118,870 A * 10/1978 Dyson ..... A45D 40/30 33/512
(Continued)

FOREIGN PATENT DOCUMENTS

FR 730 333 8/1932
JP 2003304930 A * 10/2003
(Continued)

OTHER PUBLICATIONS

Polypropylene-13 Material Table, 2022, Periodic Table, material-properties.org (Year: 2022).*
(Continued)

*Primary Examiner* — Cris L. Rodriguez
*Assistant Examiner* — Kylie M. Gaspar
(74) *Attorney, Agent, or Firm* — Oblon, McClelland, Maier & Neustadt, L.L.P.

(57) ABSTRACT

A stencil suitable for the application of a wing (V) of eyeliner at the outer corner of an eye, that includes a planar main body having a first and a second opposing front faces, a lateral edge portion including a positioning edge, wherein the positioning edge includes a notch defining a receiving space for the eyeliner, the notch including a first segment having a first end connected to the positioning edge and a second opposite end, the positioning edge is configured to be
(Continued)

placed parallel to the midline of the face, and the first segment forms, with the positioning edge, an angle α of between 95° and 145°.

14 Claims, 5 Drawing Sheets

(58) Field of Classification Search
USPC ..... 132/319, 200, 286–318
See application file for complete search history.

(56) References Cited

U.S. PATENT DOCUMENTS

| | | | | |
|---|---|---|---|---|
| 4,936,325 | A * | 6/1990 | Davis | A45D 40/30 132/319 |
| 5,178,170 | A * | 1/1993 | Kassai | A45D 44/12 132/319 |
| 2004/0107975 | A1* | 6/2004 | Bender | A45D 40/30 132/319 |
| 2006/0225671 | A1* | 10/2006 | Atherley | F02M 25/10 123/527 |
| 2010/0018542 | A1 | 1/2010 | Konrad | |
| 2013/0284197 | A1* | 10/2013 | Yeo | A45D 40/30 132/319 |
| 2014/0209114 | A1* | 7/2014 | Johnson | A45D 37/00 132/319 |
| 2015/0374101 | A1* | 12/2015 | Levi | A45D 40/30 132/319 |
| 2016/0286935 | A1* | 10/2016 | Macias-Abu | A45D 40/30 |
| 2016/0286936 | A1* | 10/2016 | Ashburn | A45D 34/04 |
| 2017/0049216 | A1* | 2/2017 | Rhoades | A45D 40/30 |
| 2017/0049217 | A1* | 2/2017 | Ahn | A45D 40/30 |
| 2018/0317632 | A1* | 11/2018 | Cox | A45D 40/30 |
| 2019/0070891 | A1* | 3/2019 | Kurani | G06F 3/0346 |

FOREIGN PATENT DOCUMENTS

| | | | | |
|---|---|---|---|---|
| JP | 2011-152317 | A | 8/2011 | |
| WO | WO 2014/122640 | A1 | 8/2014 | |
| WO | WO-2014122640 | A1 * | 8/2014 | A45D 40/20 |

OTHER PUBLICATIONS

International Search Report dated Aug. 13, 2019 in PCT/EP2019/062698 filed on May 16, 2019.

* cited by examiner

STENCIL FOR THE APPLICATION OF EYELINER IN ORDER TO FORM A WING OF EYELINER AT THE OUTER CORNER OF AN EYE

The present invention relates to the field of accessories for the application of cosmetic products, said accessories comprising a substantially planar main body.

More particularly, according to a first aspect, the invention relates to a stencil suitable for the application of eyeliner in order to form a wing of eyeliner at the outer corner of an eye, said stencil comprising a substantially planar main body and having:

- a first front face;
- a second front face opposite the first front face;
- a lateral edge portion connecting the first and second front faces and comprising a positioning edge.

Document WO2014122640 describes such a stencil making it possible to produce simultaneously the drawing of a wing of eyeliner at the outer corner of an eye to be made up and the drawing of a line of eyeliner on the eyelid at the root of the eyelashes.

Thus, in this document WO2014122640, the stencil has an edge for positioning the stencil on the eyelid to be made up. The positioning edge must be placed substantially horizontally by the user at the outer corner of the eye that they wish to make up. This positioning edge has a notch defining a space for receiving eyeliner, enabling the user, once the stencil is positioned on the eyelid of the eye to be made up, with one of the front faces thereof bearing against the eyelid, to draw both a wing of eyeliner at the outer corner of an eye to be made up, and a line of eyeliner on the eyelid at the root of the eyelashes. The part of the notch of the stencil according to this document WO2014122640 that corresponds to the wing to be drawn at the outer corner of an eye to be made up is in communication, by forming an angle, with the part of the notch of the stencil that corresponds to the line of eyeliner to be drawn on the eyelid at the root of the eyelashes.

Nonetheless, the stencil according to document WO2014122640 is not entirely satisfactory, especially in terms of intuitive use, precision of the drawing of the wing of eyeliner at the outer corner of the eye to be made up, repeatability of the drawing of the wing of eyeliner at the outer corner of the same eye to be made up from one eyeliner application to another, or else symmetry of the drawing of the wing of eyeliner at the outer corners of the right and left eyes.

This is because, with the stencil according to this document WO2014122640, the placing of the positioning edge at the outer corner of the eye to be made up and of the notch on the eyelid of the same eye from one eyeliner application to another is difficult to repeat, especially due to the curvature of the face in the horizontal plane passing through the outer corner of the eye to be made up, which leads to differences in the drawing of the wing of eyeliner at the outer corner of the same eye to be made up from one eyeliner application to another.

Similarly, with the stencil according to this document WO2014122640, it is particularly difficult to place the positioning edge symmetrically at the outer corners of the right and left eye and the notch symmetrically on the eyelids of the right and left eyes during the same operation for making up the eyes, which is liable to cause asymmetry between the wing drawn at the outer corner of the right eye and the wing drawn at the outer corner of the left eye.

Moreover, with the stencil according to this document WO2014122640, the position of the part of the notch that corresponds to the wing to be drawn at the outer corner of an eye to be made up is dependent on that of the part of the notch of the stencil that corresponds to the line of eyeliner to be drawn on the eyelid at the root of the eyelashes. The most pleasing drawing of a line of eyeliner on the eyelid at the root of the eyelashes of an eye to be made up may however prove harmful to/in contradiction with the most pleasing drawing of a wing of eyeliner at the outer corner of an eye to be made up.

Finally, with the stencil according to this document WO2014122640, due to the fact that the part of the notch corresponding to the wing to be drawn at the outer corner of an eye to be made up is in communication with the part of the notch of the stencil corresponding to the line of eyeliner to be drawn on the eyelid at the root of the eyelashes, the user is forced to close the eye that they wish to make up in order to apply eyeliner to said eye, which makes this make-up operation tricky and difficult to repeat from one eyeliner application to another.

According to a first aspect, the present invention aims to overcome all or some of these drawbacks and to this end proposes a stencil of the abovementioned type, in which the positioning edge is substantially rectilinear extending along a positioning axis and comprises a notch opening onto the first and second front faces and onto the positioning edge and defining a receiving space for the eyeliner, said notch comprising a first segment having a first end connected to the positioning edge and a second opposite end,

- wherein the positioning edge is configured to be placed parallel to the midline of the face,
- and wherein the first segment forms, with the positioning edge, an angle of between 95° and 145°, preferably of between 110° and 130°, and in particular close to 120°.

The angle formed between the first segment and the positioning edge is measured from the positioning edge towards the first segment.

The positioning edge advantageously has a length measured along the positioning axis of greater than or equal to 15 mm, especially greater than or equal to 20 mm, preferably greater than or equal to 25 mm, for example close to 35 mm. Such a minimum length of the positioning edge enables the user to reliably and precisely position the stencil by placing this positioning edge parallel to the midline of the face.

In accordance with a general definition in the field of human anatomy, the midline of the face corresponds to an imagined line separating the face into two substantially equal parts, right and left.

By virtue of these provisions, according to a first aspect, the invention proposes a stencil making it possible to produce a precise and optimum drawing, or at the very least one which is pleasing and attractive, of a wing of eyeliner at the outer corner of an eye to be made up, with good intuitive use, improved repeatability of the drawing of the wing of eyeliner at the outer corner of the same eye to be made up from one eyeliner application to another, and making it possible to obtain better symmetry of the drawing of the wing of eyeliner at the outer corners of the right and left eyes during the same application of eyeliner to the outer corners of the eyes.

Indeed, with the stencil according to the first aspect of the invention, the positioning edge is intended to be placed parallel to the midline of the face when the stencil is brought into contact with the face of a user, with the first end of the first segment of the notch positioned adjacent to the outer corner of the eye on which it is desired to draw the wing of eyeliner. Thus, the precise, repeatable and symmetrical placement from one eye to the other of the positioning edge of the stencil on the face is facilitated due to the fact that the user has a reference line consisting of the midline of the face, relative to which they may readily position the positioning edge of the stencil.

Moreover, the angle formed between the first segment of the notch and the positioning edge makes it possible to draw a pleasing and attractive wing at the outer corner of an eye to be made up, by following this first segment.

Indeed, it is known in the field of professional make-up artists to form a virtual guide line for the drawing of a wing of eyeliner at the outer corner of an eye to be made up, using a rectilinear element such as a pen or a brush handle held so as to connect the outer corner of the eye to be made up and the base of the nose. According to the practice of these make-up professionals, an optimum, pleasing and attractive drawing of a wing of eyeliner at the outer corner of an eye is obtained by drawing a line from the outer corner of the eye to be made up, following this virtual line.

As a variant, some professional make-up artists take, as virtual guide line for the drawing of a wing of eyeliner at the outer corner of an eye to be made up, a straight line connecting the outer corner of the eye to be made up and the wing of the nose located on the side of the eye to be made up.

Nonetheless, this practice requires a certain amount of dexterity and thus proves to be tricky and difficult to repeat for a standard user.

By virtue of the first aspect of the present invention, the user has a stencil which is simple and intuitive to use, enabling them to draw, reliably, repeatably and symmetrically from one eye to the other, a wing of eyeliner at the outer corner of the eye, this wing having an optimum, pleasing and attracting orientation, such as that recommended by make-up professionals, by holding the stencil with the positioning edge parallel to the midline of the face, the first end of the first segment of the notch being positioned adjacent to the outer corner of the eye to be made up, and by drawing a line according to this first segment by means of an eyeliner applicator tip.

With an angle between the first segment and the positioning edge of between 110° and 130°, and in particular close to 120°, when the user applies the stencil against his skin, for example via the first front face of the main body, close to the outer corner of the eye, orients the positioning edge parallel to the midline of the face, with the first segment of the notch extending upwards from the positioning edge, and places the first end of the first segment of the notch at the outer corner of the eye, the first segment points optimally, considering the variety of existing face shapes, towards the base of the nose.

With an angle between the first segment and the positioning edge of between 120° and 140°, and in particular close to 130°, when the user applies the stencil against his skin, for example via the first front face of the main body, close to the outer corner of the eye, orients the positioning edge parallel to the midline of the face, with the first segment of the notch extending upwards from the positioning edge, and places the first end of the first segment of the notch at the outer corner of the eye, the first segment points optimally, considering the variety of existing face shapes, towards the wing of the nose located on the side of the eye to be made up.

"Extending upwards" is intended to mean that the first segment of the notch extends in the direction of the top of the face when the stencil is placed against the skin, with the positioning edge extending parallel to the midline of the face.

Although two particular angles between the first segment and the positioning edge have been described above, other values for angles between the first segment and the positioning edge within the range extending between 95° and 145°, and preferably between 110° and 130°, are conceivable within the context of the present invention in order to obtain wings having different inclinations relative to the midline of the face and the eyeline.

According to other advantageous aspects, the stencil according to the first aspect of the invention includes one or more of the following features, taken separately or in any technically possible combinations:

- the notch comprises a second segment having a first end connected to the positioning edge and a second opposite end connected to the second end of the first segment,
- and the first end of the first segment and the first end of the second segment are separated by a distance measured along the positioning axis, said distance being especially between 3 mm and 6 mm, preferably between 4 mm and 5 mm, and in particular close to 4.5 mm. By virtue of these provisions, the user has a stencil enabling them to produce a wing at the outer corner of an eye to be made up having a calibrated geometry by filling the receiving space of the notch defined by the first and second segments and by the positioning edge with eyeliner, the shape of the wing drawn corresponding to that of the receiving space of the notch.
- the first segment and/or the second segment of the notch is (are) substantially rectilinear. Thus, the wing of eyeliner drawn at the outer corner of the eye to be made up has a clearly-defined triangular shape.
- the second segment forms, with the first segment, an angle of between 5° and 35°, preferably of between 10° and 30°, and in particular close to 20°. By virtue of these provisions, the wing of eyeliner drawn at the outer corner of an eye to be made up has a harmonious, optimized shape.
- the lateral edge portion has a triangular contour, preferably with rounded angles. In other words, the stencil, the main body of which is substantially planar, has a generally triangular shape, preferably with rounded edges. Such a triangular shape for the stencil makes it possible to improve the intuitive use of the stencil. Moreover, such a triangular shape makes it possible to reproduce the shape of the wing which can be drawn by means of the stencil. In particular, the contour of the lateral edge portion of the stencil may define a non-isosceles right-angled triangle comprising a hypotenuse, a long edge formed by the positioning edge and a short edge. In this case, the stencil advantageously has an arrow shape defined by the positioning edge and the hypotenuse of the triangle formed by the contour of the stencil, this arrow pointing towards the bottom of the face when the stencil is placed at the outer corner of an eye to be made up, thereby helping the user to correctly orient the stencil on his face, with the positioning edge parallel to the midline of the face, with the first segment of the notch extending upwards from the positioning edge.
- the stencil is made of plastic material, especially of thermoplastic material, such as polypropylene (PP), polyethylene (PE), polyethylene terephthalate (PET), acrylonitrile butadiene styrene (ABS), polybutylene terephthalate (PBT), polyvinyl chloride (PVC), polytetrafluoroethylene (PTFE), and in particular polycyclohexylenedimethylene terephthalate (PCTA), advantageously having a Young's modulus of between 0.5 MPa and 5 MPa, preferably of between 0.7 MPa and 3 MPa, and in particular close to 1.3 MPa. Such a plastic material makes it possible to obtain a sufficiently flexible stencil to adapt to the surface irregularities and specificities of each face at the outer corner of an eye to be made up, while being sufficiently stiff to be able to be handled by the user and enable a clearly defined, precise and repeatable drawing of an eyeliner wing at the outer corner of an eye to be made up, following the first segment and, where appropriate, the second segment, of the notch. Moreover, the use of a plastic material to produce the stencil makes it possible to limit the manufacturing costs thereof. As a variant, the stencil may be made of metal material, such as brass, steel, aluminium, copper, iron, zamak, etc.

the first segment and/or the second segment of the notch has a sealing rim protruding from the first front face and/or from the second front face of the main body, especially by a protrusion distance of between 20% and 40%, for example close to 30%, of the distance separating the first and second front faces, said protrusion distance being for example between 0.1 mm and 0.3 mm and in particular close to 0.2 mm. The distance separating the first and second front faces of the main body of the stencil advantageously corresponds to the thickness of the stencil. Advantageously, the distance separating the first and second front faces is between 0.01 mm and 1 mm, in particular in order to enable an applicator tip of a cosmetic product, and in particular of eyeliner, to be able to correctly penetrate into the notch and precisely follow the first and second segments thereof. The protrusion distance is measured perpendicular to the first and/or to the second front face(s). The sealing rim is configured to be placed in contact with the skin, so as to locally deform the skin along the first and the second segment of the notch. By virtue of these provisions, the leaktightness between the skin and the notch at the first and second segments when the stencil is brought into contact with the face of a user via its first or its second front face is improved, which makes it possible to limit the risk that the eyeliner applied in the receiving space of the notch will bleed, seeping between the skin and the first or the second front face brought into contact with the face, which would risk harming the quality and definition of the makeup produced.

the sealing rim has a triangular cross section so as to form a sealing ridge configured to be placed in contact with the skin, so as to locally deform the skin along the first and the second segments of the notch. Such a triangular shape of the cross section of the sealing rim makes it possible to further improve the leaktightness between the skin and the notch at the first and second segments when the stencil is brought into contact with the face of a user via the first or second front face thereof, since a localised positive pressure is generated between the skin and the sealing ridge.

The first aspect of the present invention also relates to a process for using a stencil as defined above to produce the drawing of a wing of eyeliner at the outer corner of a first eye to be made up, comprising the steps consisting in:

placing one of the first or the second front face in contact with the face, close to the outer corner of the first eye to be made up;

positioning the positioning edge parallel to the midline of the face, with the first segment of the notch extending upwards from said positioning edge;

placing the first end of the first segment of the notch connected to the positioning edge at the outer corner of the first eye to be made up;

drawing a wing of eyeliner at the outer corner of the first eye to be made up, following the first segment of the notch.

"Extending upwards" is intended to mean that the first segment of the notch extends in the direction of the top of the face when the stencil is placed against the skin, with the positioning edge extending parallel to the midline of the face.

Advantageously, the abovementioned process may also be used for producing the drawing of a wing of eyeliner at the outer corner of a second eye to be made up, said process then comprising the additional steps consisting in:

placing the other of the first or the second front face in contact with the face, close to the outer corner of the second eye to be made up;

positioning the positioning edge parallel to the midline of the face, with the first segment of the notch extending upwards from said positioning edge;

placing the first end of the first segment of the notch connected to the positioning edge at the outer corner of the second eye to be made up;

drawing a wing of eyeliner at the outer corner of the second eye to be made up, following the first segment of the notch.

When the abovementioned process employs a stencil, the notch of which has a second segment connected to the first segment as defined above, it advantageously comprises an additional step consisting in filling the receiving space of the notch defined by the first and second segments and by the positioning edge with eyeliner, so as to form a wing of eyeliner at the outer corner of the first and/or second eye to be made up, the shape of which corresponds to the shape of the receiving space of the notch.

Finally, the first aspect of the invention also proposes an assembly comprising:

a stencil as defined previously, and a cap suitable for closing a container of eyeliner and extending along a longitudinal axis;

wherein the stencil can move between a stowed configuration in which it is secured to the cap and a use configuration in which it is detached from the cap.

According to an advantageous provision of the assembly according to the first aspect of the invention, the cap comprises a receiving groove extending parallel to the longitudinal axis and suitable for receiving at least a portion of the stencil forming a rail in the stowed configuration of the stencil.

Preferably, the assembly according to the first aspect of the invention also comprises a container of eyeliner, especially a container in the form of an eyeliner pen comprising a reservoir of eyeliner and an applicator tip, especially made of porous and/or fibrous material and in fluid communication with the reservoir.

As a variant, the eyeliner container of the assembly according to the first aspect of the invention may be in the form of a bottle and the cap may belong to a submerged applicator comprising a rod, one end of which is connected to the cap and the opposite end of which is provided with an applicator member suitable for being submerged inside the bottle which forms a reservoir of eyeliner, in order to be loaded with eyeliner.

According to a second aspect, the invention relates to a stencil suitable for the application of a cosmetic product in fluid or pulverulent form, in particular a makeup or care product, to the skin, said stencil comprising a substantially planar main body and having:

- a first front face;
- a second front face opposite the first front face;
- a lateral edge portion connecting the first and second front faces;
- a through-cavity opening onto the first and second front faces and delimited by a border defining a space for receiving the cosmetic product.

Document WO2014122640, already cited above, describes such a stencil, the through-cavity of which is in the form of a notch, making it possible to produce simultaneously the drawing of a wing of eyeliner at the outer corner of an eye to be made up and the drawing of a line of eyeliner on the eyelid at the root of the eyelashes.

With a stencil according to this document WO2014122640, there is a risk that the cosmetic product, in this case eyeliner, applied in the receiving space defined by the notch will bleed, seeping between the skin and the first or the second front face brought into contact with the face, thereby harming the appearance of the makeup applied.

Thus, there is a need to develop a stencil as defined previously, in which means are employed to improve the leaktightness of the space for receiving cosmetic product when the stencil is brought into contact with the skin via the first or the second front face thereof.

Such an aim is particularly crucial in the context of application of a cosmetic make up product to the face by means of a stencil, since the attractiveness of the result obtained, and obtaining a clearly-defined contour of the mark of the makeup product applied, are essential.

Nonetheless, more generally speaking, developing a stencil for which the space for receiving product, defined by a cavity with a closed contour, that is to say that does not open onto the edge portion of the stencil, or with an open contour, that is to say that does open onto the edge portion of the stencil, having an improved leaktightness for cosmetic products, is particularly beneficial in the context of the application of any cosmetic product to a keratin surface such as the skin or the lips, for example in fluid or pulverulent form, whether this is a make-up product such as eyeliner, blusher, lipstick, etc., or a care product.

In order to achieve this aim, the invention according to the second aspect proposes a stencil of the abovementioned type, in which the border has a sealing rim protruding from the first front face and/or from the second front face of the main body and configured to be placed in contact with the skin, so as to locally deform the skin along the border of the cavity.

By virtue of these provisions, the leaktightness between the skin and the border of the cavity of the stencil when the stencil is brought into contact with the face of a user via its first or its second front face is improved, which makes it possible to limit the risk that the cosmetic product, and in particular the eyeliner, applied in the receiving space of the cavity, will bleed, seeping between the skin and the first or the second front face brought into contact with the face.

Thus, in the context of an application of a make-up product to the skin, such as eyeliner, in the receiving space of the cavity of the stencil according to the second aspect of the invention, it is ensured that the line of makeup applied to the skin has a clearly-defined contour corresponding to that defined by the border of the cavity.

According to other advantageous aspects, the stencil according to the second aspect of the invention includes one or more of the following features, taken separately or in any technically possible combinations:

- the positioning edge advantageously has a length measured along the positioning axis of greater than or equal to 15 mm, especially greater than or equal to 20 mm, preferably greater than or equal to 25 mm, for example close to 35 mm. Such a minimum length of the positioning edge enables the user to reliably and precisely position the stencil by placing this positioning edge parallel to the midline of the face.
- the sealing rim has a triangular cross section so as to form a sealing ridge. Such a triangular shape of the cross section of the sealing rim makes it possible to further improve the leaktightness between the skin and the cavity of the border when the stencil is brought into contact with the face of a user via the first or second front face thereof, since a localised positive pressure is generated between the skin and the sealing ridge.
- the sealing rim protrudes from the first front face and/or the second front face of the main body by a protrusion distance of between 20% and 40%, for example close to 30%, of the distance separating the first and second front faces. The protrusion distance is for example between 0.1 mm and 0.3 mm and in particular close to 0.2 mm. The distance separating the first and second front faces of the main body of the stencil advantageously corresponds to the thickness of the stencil. Advantageously, the distance separating the first and second front faces is between 0.01 mm and 1 mm, in particular in order to enable an applicator tip of a cosmetic product, and in particular of eyeliner, to be able to correctly penetrate into the through-cavity and follow the border thereof. The protrusion distance is measured perpendicular to the first and/or to the second front face(s).
- the through-cavity opens onto the lateral edge portion of the stencil so as to form a notch on said lateral edge portion. In this case, the through-cavity does not have a closed contour since the border of the through-cavity is open at the lateral edge portion of the stencil. As a variant, it is possible to provide for the through-cavity to have a closed contour with the border of the through-cavity being closed onto itself.
- the lateral edge portion has a substantially rectilinear positioning edge extending along a positioning axis,
- the positioning edge is configured to be placed parallel to the midline of the face,
- and the notch comprises a first segment having a first end connected to the positioning edge and a second opposite end, said first segment forming, with the positioning edge, an angle of between 95° and 145°, preferably of between 110° and 130°, and in particular close to 120°.
- the notch comprises a second segment having a first end connected to the positioning edge and a second opposite end connected to the second end of the first segment,
- and the first end of the first segment and the first end of the second segment are separated by a distance measured along the positioning axis, said distance especially being between 3 mm and 6 mm, preferably between 4 mm and 5 mm, and in particular close to 4.5 mm.

the stencil is made of plastic material, especially of thermoplastic material, such as polypropylene (PP), polyethylene (PE), polyethylene terephthalate (PET), acrylonitrile butadiene styrene (ABS), polybutylene terephthalate (PBT), polyvinyl chloride (PVC), polytetrafluoroethylene (PTFE), and in particular polycyclohexylenedimethylene terephthalate (PCTA), advantageously having a Young's modulus of between 0.5 MPa and 5 MPa, preferably of between 0.7 MPa and 3 MPa, and in particular close to 1.3 MPa. Such a plastic material makes it possible to obtain a sufficiently flexible stencil to adapt to the surface irregularities of the region of the face to which it is desired to apply the cosmetic product, and to the specificities of each face, while being sufficiently stiff to be able to be handled by the user and enable a clearly defined, precise and repeatable application of the cosmetic product to the region of the face to which it is desired to apply the cosmetic product, following the border of the notch. Moreover, the use of a plastic material to produce the stencil makes it possible to limit the manufacturing costs thereof. As a variant, the stencil may be made of metal material, such as brass, steel, aluminium, copper, iron, zamak, etc.

the stencil is suitable for the application of eyeliner in order to form a wing of eyeliner at the outer corner of an eye. In this context, the stencil according to the second aspect of the invention may have one, another, or a combination of the features described in relation to the stencil according to the first aspect of the invention.

The second aspect of the invention also relates to a process for using a stencil as described above in order to apply a cosmetic product in fluid or pulverulent form, in particular a make-up or care product, to the skin, comprising the steps consisting in:

placing one of the first or the second front face in contact with the skin, with the through-cavity located level with the region of the skin to which it is desired to apply the cosmetic product;

pressing said first or second front face against the skin such that the sealing rim locally deforms the skin along the border of the through-cavity;

applying cosmetic product to the region of the skin to which it is desired to apply the cosmetic product, through the through-cavity.

When the abovementioned process employs a stencil having a through-cavity in the form of a notch opening onto the edge portion of the stencil and having a first segment, said stencil having a positioning edge that forms a particular angle with this first segment of the notch, it may advantageously be employed to produce the drawing of a wing of eyeliner at the outer corner of an eye to be made up, and comprises the steps consisting in:

placing one of the first or the second front face in contact with the face, close to the outer corner of the eye to be made up;

positioning the positioning edge parallel to the midline of the face, with the first segment of the notch extending upwards from said positioning edge;

placing the first end of the first segment of the notch connected to the positioning edge at the outer corner of the eye to be made up;

drawing a wing of eyeliner at the outer corner of the eye to be made up, following the first segment of the notch.

"Extending upwards" is intended to mean that the first segment of the notch extends in the direction of the top of the face when the stencil is placed against the skin, with the positioning edge extending parallel to the midline of the face.

In this context, the process for using the stencil according to the second aspect of the invention may have one, another, or a combination of the features described in relation to the process for using the stencil according to the first aspect of the invention.

Finally, the second aspect of the invention also proposes an assembly comprising:

a stencil as defined previously, and a cap suitable for closing a container of cosmetic product, and in particular eyeliner, and extending along a longitudinal axis;

wherein the stencil can move between a stowed configuration in which it is secured to the cap and a use configuration in which it is detached from the cap.

According to an advantageous provision of the assembly according to the second aspect of the invention, the cap comprises a receiving groove extending parallel to the longitudinal axis and suitable for receiving at least a portion of the stencil forming a rail in the stowed configuration of the stencil.

Preferably, the assembly according to the second aspect of the invention also comprises a container of eyeliner, especially a container in the form of an eyeliner pen comprising a reservoir of eyeliner and an applicator tip, especially made of porous and/or fibrous material and in fluid communication with the reservoir.

As a variant, the cosmetic product container of the assembly according to the second aspect of the invention may be in the form of a bottle and the cap may belong to a submerged applicator comprising a rod, one end of which is connected to the cap and the opposite end of which is provided with an applicator member suitable for being submerged inside the bottle which forms a reservoir of cosmetic product, in order to be loaded with cosmetic product.

According to a third aspect, the invention relates to an assembly comprising:

a cap suitable for closing a container of cosmetic product, especially in fluid or pulverulent form, in particular a make-up or care product, said cap extending along a longitudinal axis, an accessory for the application of the cosmetic product, said accessory comprising a substantially planar main body;

said accessory being able to move between a stowed configuration in which it is secured to the cap and a use configuration in which it is detached from the cap.

Document U.S. Pat. No. 5,178,170 describes such an assembly, in which the accessory is a guide for the drawing of eyeliner on the eyes; in the assembly according to this document, the guide for eyeliner is formed of two substantially planar leaflets which pivot relative to one another, a first leaflet forming the active part of the guide and the second leaflet being provided with tabs for snap-fastening to a cylindrical element, such as a cap, of a device for packaging make-up products.

In the assembly according to this document U.S. Pat. No. 5,178,170, the reliability of holding the guide for eyeliner in the stowed configuration on the cylindrical element is liable to decrease over time and over successive uses of the guide. This is because the snap-fastening system providing the holding of the guide on the cylindrical element is subject to slackening following numerous uses, since the elastic recovery capacity of the snap-fastening tabs is liable to decrease over time.

According to a third aspect thereof, the aim of the invention is to overcome these disadvantages, and to this end it proposes an assembly of the abovementioned type, in which the cap comprises a receiving groove extending parallel to the longitudinal axis and suitable for receiving at least a portion of the accessory forming a rail in the stowed configuration of the accessory.

By virtue of these provisions, the third aspect of the invention proposes an assembly in which the reliability of holding the accessory in the stowed position on the cap is improved.

According to other advantageous aspects, the assembly according to the third aspect of the invention includes one or more of the following features, taken separately or in any technically possible combinations:

- the cap has an outer peripheral surface comprising two wings facing one another extending parallel to the longitudinal axis and defining, between them, the groove for receiving the accessory.
- the receiving groove extends between a first open end in the direction of the longitudinal axis and a second opposite end.
- the second end of the groove is provided with a stop for stopping the accessory in the direction of the longitudinal axis.
- the main body of the accessory has a first front face, a second front face opposite the first front face and a lateral edge portion connecting said first and second front faces and comprising a substantially rectilinear positioning edge,
- and the portion of the accessory that forms a rail, suitable for being received in the receiving groove of the cap in the stowed configuration of the accessory, comprises said positioning edge.
- the receiving groove comprises a guide cluster protruding inside said receiving groove,
- a front face of the accessory has a guide groove extending parallel to the positioning edge,
- and said guide groove cooperates with said guide cluster to guide the accessory relative to the cap between its use configuration and its stowed configuration and to block the accessory relative to the cap in its stowed configuration in a direction perpendicular to the longitudinal axis.
- the receiving groove also comprises a blocking stud protruding inside said receiving groove,
- the guide groove comprises a blocking protrusion protruding inside said guide groove,
- and said blocking protrusion cooperates with said blocking stud to block said accessory in the stowed configuration relative to the cap along the longitudinal axis, on the side of the first open end in the direction of the longitudinal axis of the receiving groove.
- the accessory is a stencil suitable for the application of eyeliner in order to form a wing at the outer corner of an eye. In this context, the stencil according to the third aspect of the invention may have one, another, or a combination of the features described in relation to the stencil according to the first and/or second aspect of the invention.

Preferably, the assembly according to the third aspect of the invention also comprises a container of cosmetic product, in particular of eyeliner, especially a container in the form of a pen comprising a reservoir of cosmetic product and an applicator tip, especially made of porous and/or fibrous material, in fluid communication with the reservoir.

As a variant, the cosmetic product container of the assembly according to the third aspect of the invention may be in the form of a bottle and the cap may belong to a submerged applicator comprising a rod, one end of which is connected to the cap and the opposite end of which is provided with an applicator member suitable for being submerged inside the bottle which forms a reservoir of cosmetic product, in order to be loaded with cosmetic product.

According to one advantageous provision of the assembly according to the third aspect of the invention, the accessory and/or the cap is (are) made of plastic material, especially of thermoplastic material, such as polypropylene (PP), polyethylene (PE), polyethylene terephthalate (PET), acrylonitrile butadiene styrene (ABS), polybutylene terephthalate (PBT), polyvinyl chloride (PVC), polytetrafluoroethylene (PTFE), and in particular polycyclohexylenedimethylene terephthalate (PCTA), advantageously having a Young's modulus of between 0.5 MPa and 5 MPa, preferably of between 0.7 MPa and 3 MPa, and in particular close to 1.3 MPa.

The choice of these plastic materials is particularly advantageous in the context of the third aspect of the invention insofar as it makes it possible to obtain a good compromise between reliability of holding the accessory on the cap in the stowed configuration and ease for the user in moving the accessory between the stowed and use configurations thereof.

The features of the assembly described in relation with the third aspect of the invention may be applied to the assemblies according to the first and second aspects of the invention.

More generally, all the technical features described in relation to one or another of the first, second and third aspect of the invention may be employed within the subject matter of the other aspects of the invention, as long as the technical compatibility of the features defining each of these subjects is ensured.

The different aspects of the invention may be better understood from reading the following description of non-limiting exemplary embodiments thereof with reference to the appended drawings, in which.

Figure 5A:
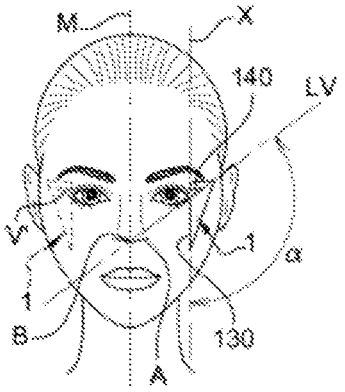
FIGS. 5A to 5E illustrate the different steps of application of a cosmetic product to the skin by means of the stencil of FIGS. 1 to 4.
Figure 5B:
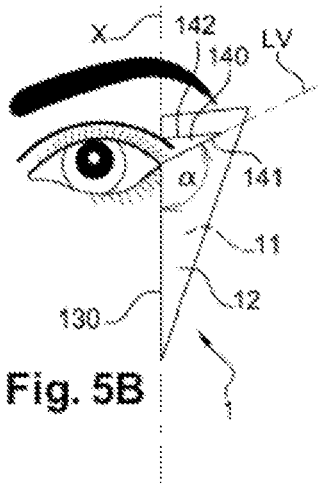
Figure 5B:
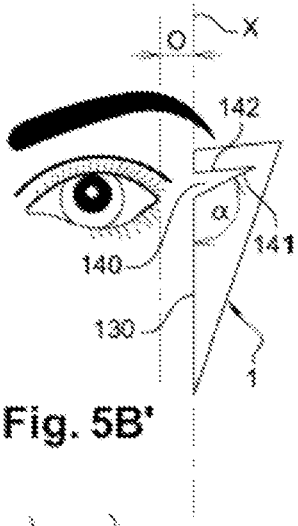
Figure 5C:
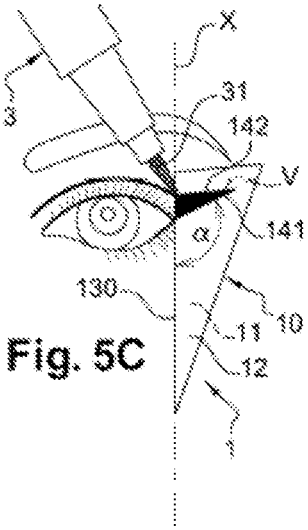
Figure 5D:
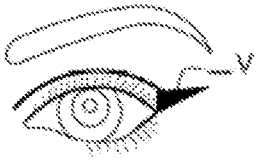
Figure 5E:
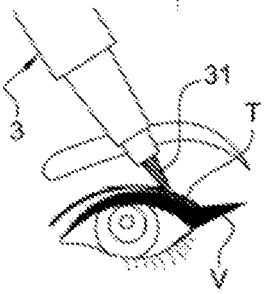
Figure 6:
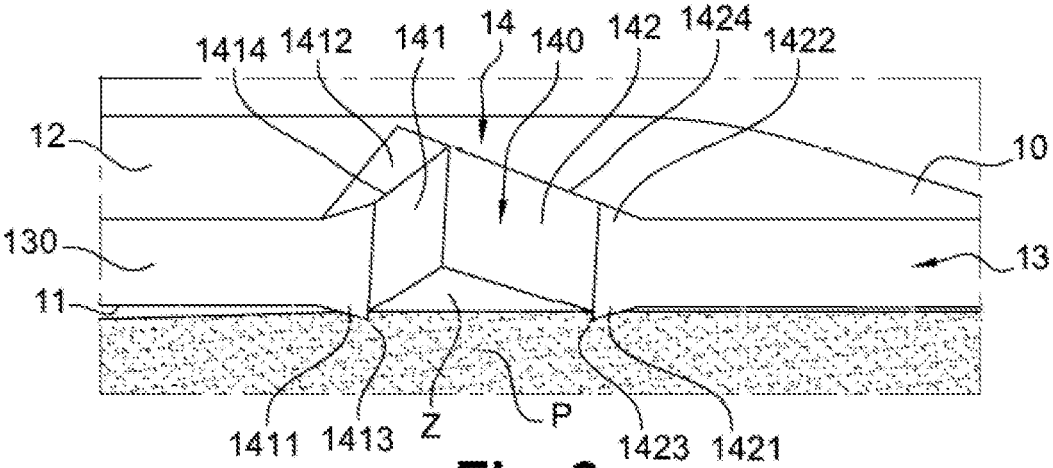
Figure 7:
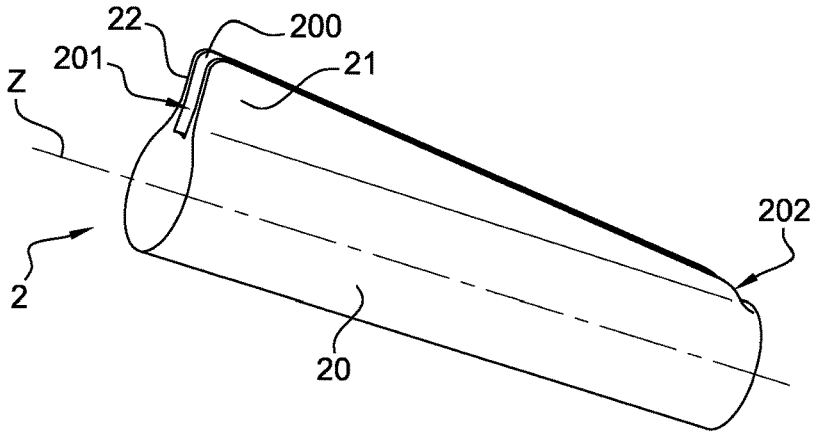
Figure 8:
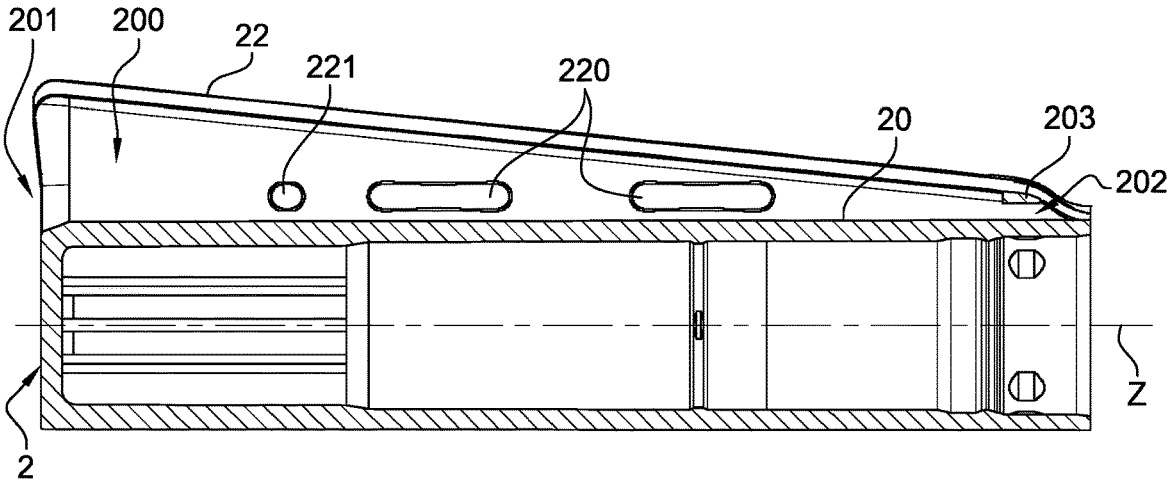
Figure 9:
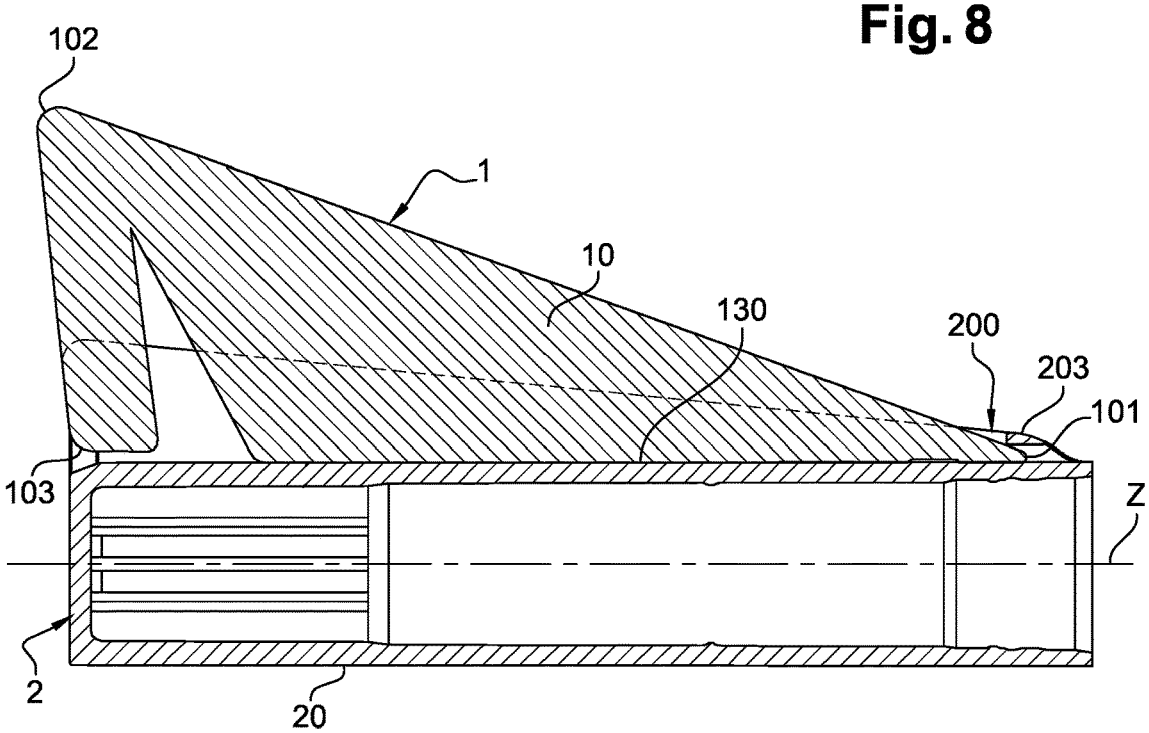
Figures 10A, 10B, 10C, 10D, 10E:
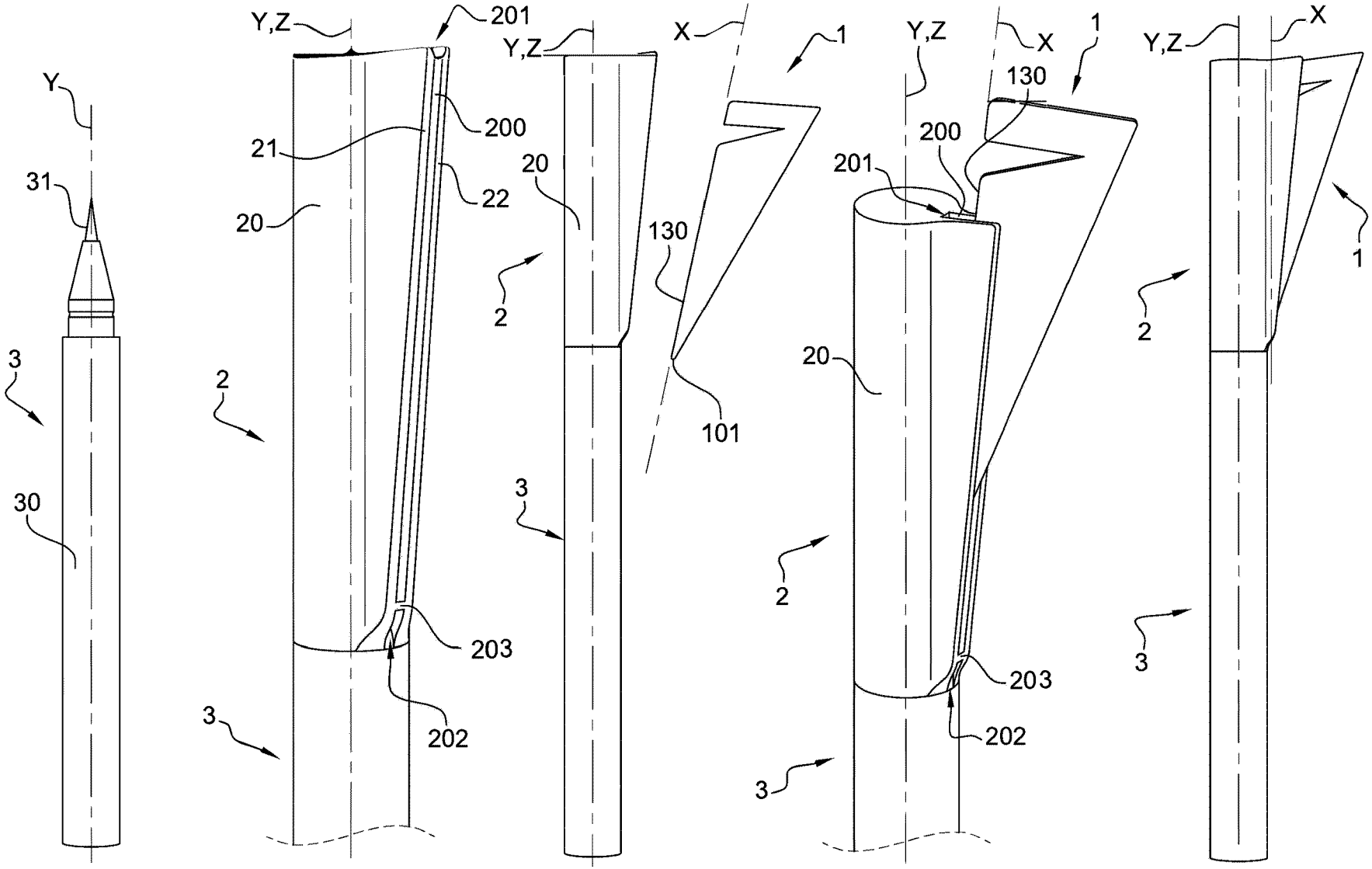

FIG. 5B' illustrates a variant of FIG. 5B;

FIG. 6 illustrates an enlarged view of the contact between the stencil of FIGS. 1 to 5 and the skin of a user;

FIG. 7 illustrates an example of cap employed within an assembly according to the first, the second and/or the third aspect of the invention;

FIG. 8 is a view in longitudinal section of the cap of FIG. 7;

FIG. 9 is a view analogous to that of FIG. 8, representing the accessory in the stowed configuration on the cap;

FIG. 10A illustrates an example of cosmetic product container employed within an assembly according to the first, the second and/or the third aspect of the invention;

FIG. 10B partially illustrates the container of FIG. 10A, combined with the cap of FIGS. 7 to 9;

FIGS. 10C to 10E illustrate the passage of the accessory from the use configuration to the stowed configuration relative to the cap of FIGS. 7 to 9 and 10B.

Figure 1:
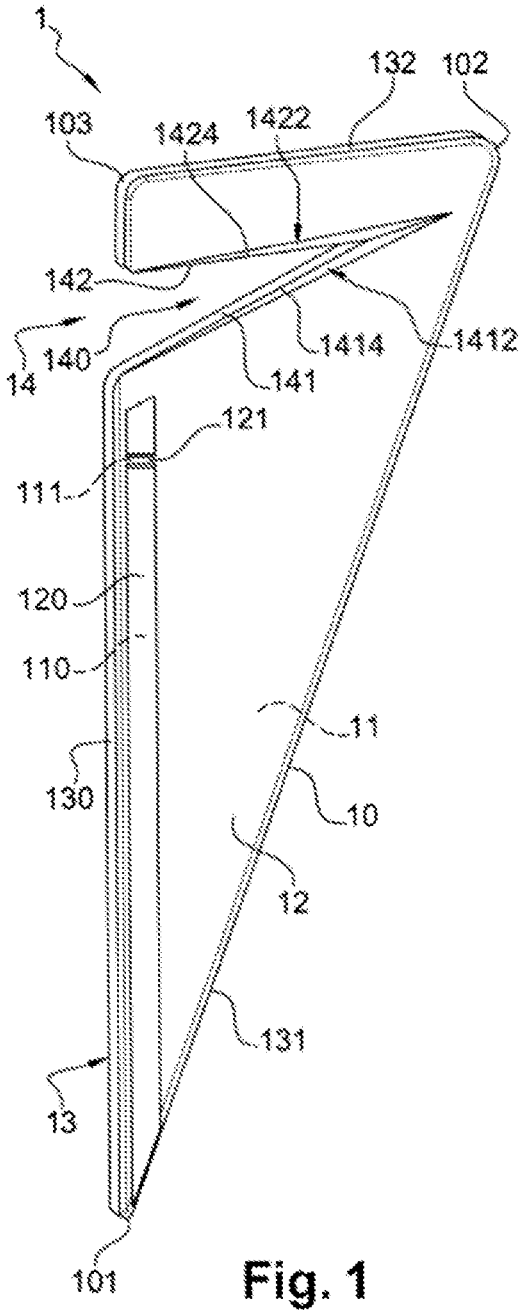
FIG. 1 illustrates a perspective view of a stencil according to the first and second aspects of the invention, which may also constitute an accessory of the assembly according to the third aspect of the invention.

FIG. 1 illustrates a perspective view of an exemplary stencil according to the first aspect or the second aspect of the invention, which may also constitute an accessory of the assembly according to the third aspect of the invention.

This stencil 1 comprises a substantially planar main body 10. Substantially planar is intended to mean that, in an orthonormal reference frame, the main body 10 has dimensions along 2 perpendicular axes which are much greater, for example at least 5 times, or even 10 times greater, than its dimension along the third axis of the orthonormal reference frame. For such a planar element, reference is commonly made to length and width for the two former dimensions, and to thickness for the third dimension.

In the exemplary embodiment of the invention illustrated in the figures, the stencil 1 is suitable for the application of eyeliner in order to form a wing V, V' of eyeliner at the outer corner of an eye, and in this instance of both eyes.

As a variant, the stencil 1, in particular according to the second aspect or the third aspect of the invention, may be suitable for the application of a cosmetic product in fluid or pulverulent form, for example a product for making up a keratin surface, in particular the skin or lips, for example a colouring cream, a blusher or eyeshadow, or else a lipstick or lip gloss, or a care product.

As clearly seen in particular in FIGS. 1 to 4, the main body 10 of the stencil 1 has a first front face 11 and a second front face 12 opposite the first front face 11.

These two front faces 11, 12 are connected by a lateral edge portion 13 defining the contour of the main body 10 of the stencil 1.

In the exemplary embodiment illustrated, the main body 10 of the stencil 1 has a contour with an overall form of a flattened triangle, the angles 101, 102, 103, being rounded, in particular so as not to present any danger to the users, especially when they use the stencil close to their eyes.

Likewise, the lateral edge portion 13 is rounded at its junctions with the front faces 11, 12.

The main edge portion 13 thus has a triangular contour, with rounded angles 101, 102, 103, and comprising three edges 130, 131, 132.

The main body 10 of the stencil 1 has a through-cavity 14 opening onto the first and second front faces 11, 12, this through-cavity 14 being delimited by a border 141, 142 defining a receiving space 140 for the cosmetic product.

Figure 2:
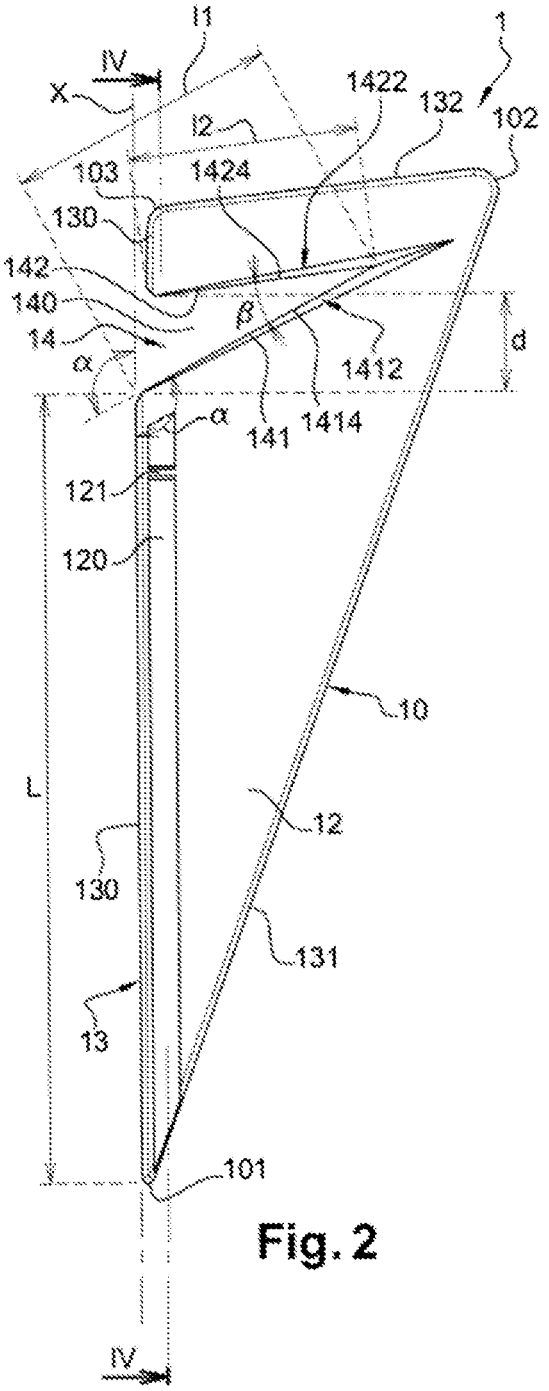
FIG. 2 is a front view of the stencil of FIG. 1.

In the exemplary embodiment illustrated, the stencil 1 is suitable for the application of eyeliner in order to form a wing V, V' of eyeliner at the outer corner of an eye; thus, and as can be seen in FIGS. 1 and 2, the through-cavity 14 is formed on the lateral edge portion 13 of the main body 10 of the stencil 1 and constitutes a notch 14, opening onto the first and second front faces 11, 12 and also onto the lateral edge portion 13.

More specifically, especially in the context of the first aspect of the invention, the notch 14 is formed on one of the edges of the lateral edge portion 13, denoted positioning edge 130.

This positioning edge 130 is substantially rectilinear extending along a positioning axis X, the purpose of which will be described below.

Thus, the notch 14 opens onto the first and second front faces 11, 12, and also onto the positioning edge 130 of the lateral edge portion 13 and defines a receiving space 140 for cosmetic product, and in particular in the context of the first aspect of the invention, for eyeliner.

As can be seen in FIGS. 1 and 2, the notch 14 has a first segment 141, a first end of which is connected to the positioning edge 130 of the edge portion 13.

In the exemplary embodiment illustrated, the notch 14 also has a second segment 142, a first end of which is connected to the positioning edge 130 of the edge portion 13.

The first and second segments 141, 142 of the notch 14 each have a second end, opposite to the first, and which are connected to one another.

Still in the exemplary embodiment illustrated, the first and second segments 141, 142 of the notch 14 are rectilinear.

As a variant, the first and/or second segments 141, 142 of the notch 14 may be curved, following axes that intersect the positioning edge 130 at the first ends of the segments 141, 142 and intersecting with one another at the second ends of the segments 141, 142.

As can be seen in FIGS. 1 and 2, the second ends of the segments 141, 142 of the notch 14 join together within the main body 10, close to the corner 102 of the edge portion 13 which is opposite the positioning edge 130.

The second segment 142 of the notch 14 advantageously forms a non-zero angle β with the first segment 141, especially of between 5° and 35°, preferably of between 10° and 30°. In the exemplary embodiment illustrated, the angle β between the first segment 141 and the second segment 142 of the notch 14 is close to 20°.

As is apparent in particular in FIGS. 1 and 2, the positioning edge 130 of the lateral edge portion 13 has a break between the portion to which the first end of the first segment 141 of the notch 14 connects and the portion to which the first end of the second segment 142 of the notch 14 connects.

Advantageously, the first end of the first segment 141 of the notch 14 and the first end of the second segment 142 of the notch 14 are separated by a non-zero distance d measured along the positioning axis X, said distance d especially being between 3 mm and 6 mm, preferably between 4 mm and 5 mm, and in particular close to 4.5 mm.

In an embodiment which is not illustrated, the notch 14 formed in the edge portion 13 of the main body 10 of the stencil 1 may only have a single segment, a first end of which is connected to the positioning edge 130 and the opposite end of which is connected to another edge 131, 132 of the edge portion 13 of the main body 10 of the stencil 1.

In this case, the notch 14 is constituted of a bevel formed in the edge portion 13 of the main body 10 of the stencil 1, and the receiving space 140 defined by the notch 14 is formed by a band adjacent to the first segment 141 and onto which a line of a cosmetic product may be drawn, following the first segment 141. In the context of an application of eyeliner, the first segment 141 thus forms a guide making it possible to draw a line of eyeliner, this line in itself possibly constituting a wing of eyeliner at the outer corner of an eye to be made up, or a rough outline for producing such a wing.

According to one advantageous provision of the invention, especially according to the first and second aspects and in particular according to the second aspect thereof, the border of the through-cavity has a sealing rim protruding from the first front face and/or from the second front face, this sealing rim being configured to be placed in contact with the skin, so as to locally deform the skin along the border of the cavity.

Thus, the leaktightness between the skin and the border of the cavity of the stencil when the stencil is brought into contact with the face of a user via its first or its second front face is improved, which makes it possible to limit the risk that the eyeliner, applied in the receiving space of the cavity, will bleed, seeping between the skin and the first or the second front face brought into contact with the face.

In the exemplary embodiment illustrated, the receiving space 140 is formed by the notch 14 and the border of the cavity is defined by the first and second segments 141, 142 of the notch 14.

Figure 3:
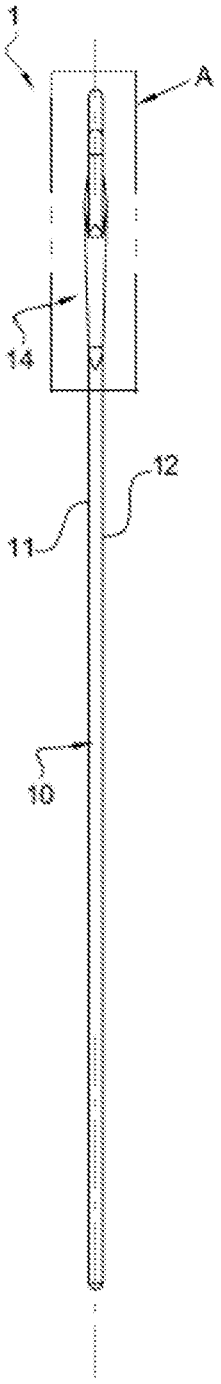
FIG. 3 is a view from the left of the stencil of FIG. 2.
Figure 3A:
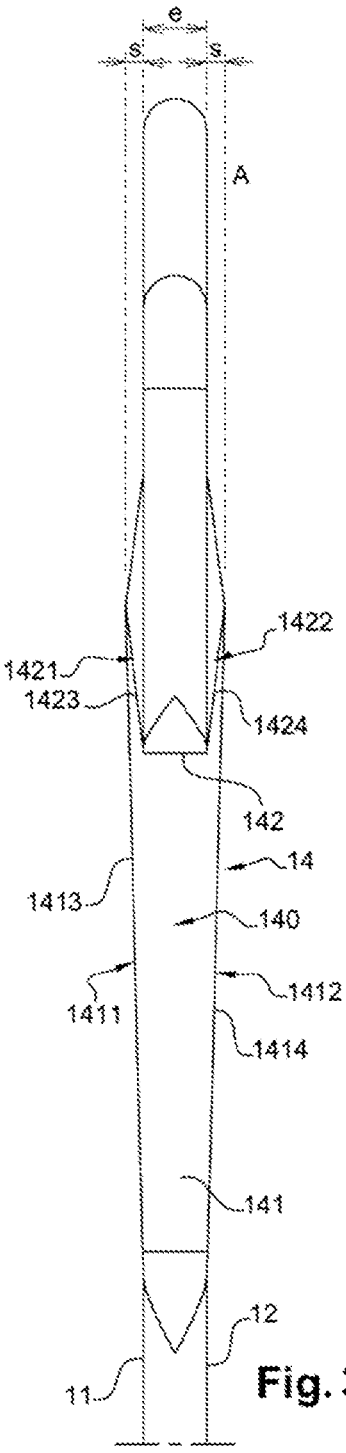
FIG. 3A is an enlarged view of the detail A of the stencil of FIG. 3.

Thus, in the exemplary embodiment illustrated and as can be seen in particular in FIGS. 3, 3A and 6, the first segment 141 and the second segment 142 of the notch 14 each have two sealing rims 1411, 1412, 1421, 1422 protruding from the first front face 11 and from the second front face 12 of the main body 10 of the stencil 1.

The main body 10 of the stencil 1 thus advantageously has symmetry relative to a plane parallel to its first and second front faces 11, 12, and intersecting its lateral edge portion 13 at the middle thereof.

Such symmetry of the main body 10 of the stencil 1 is particularly advantageous in the context of an application of cosmetic product requiring symmetry of application to the face, since the main body 10 can be selectively pressed against one region, for example located on the left-hand side of the face, to which it is desired to apply a cosmetic product, via its first front face 11, and against a symmetrical region, for example located on the right-hand side of the face, to which it is desired to apply a cosmetic product, via its second front face 12. This will thus achieve symmetrical application of cosmetic product on the right-hand and left-hand regions.

In the context of an application of eyeliner at the outer corner of the eyes using the stencil 1 according to the invention, this symmetry of the main body 10 of the stencil 1 is particularly advantageous for producing wings V, V' which are symmetrical between the outer corner of the right eye and the outer corner of the left eye, as can be seen in FIG. 5A and will be described in detail below.

Advantageously, and as can be seen in particular in FIG. 3A, the sealing rims 1411, 1412, 1421, 1422 of the first and of the second segments 141, 142 protrude from the front faces 11, 12 of the main body 10 of the stencil 1 by a protrusion distance s, measured perpendicular to said front faces 11, 12, of between 20% and 30% of the distance e separating the first and second front faces 11, 12. This protrusion distance s is for example between 0.1 mm and 0.2 mm. In the exemplary embodiment illustrated, the distance e separating the first and second front faces 11, 12 is close to 0.55 mm and the protrusion distance is close to 0.15 mm. Advantageously, the distance e separating the first and second front faces 11, 12, which corresponds substantially to the thickness of the stencil 1, is between 0.01 mm and 1 mm, in particular in order to enable a tip for applying cosmetic product, and in particular eyeliner, to be able to correctly penetrate into the notch 14 and precisely follow the first and second segments 141, 142 thereof.

Preferably, and as can be seen in particular in FIGS. 3A and 6, the sealing rims 1411, 1412, 1421, 1422 of the first and second segments 141, 142 have a triangular cross-section, so as to form a sealing ridge 1413, 1414, 1423, 1424. Such a sealing ridge 1413, 1414, 1423, 1424 further improves the leaktightness of the contact between the skin P and the first and second segments 141, 142 of the notch 14 when the stencil 1 is brought into contact with the skin P via its first or its second front face 11, 12, since localised positive pressure is generated between the skin P and the sealing ridge 1413, 1414, 1423, 1424.

Indeed, this phenomenon can be seen in FIG. 6, in which the stencil 1 is illustrated with the main body 10 bearing against the skin via its first front face 11, the sealing rims 1411, 1421 of the first and second segments 141, 142 of the notch 14 protruding from this first front face 11, locally deforming the skin along the first and second segments 141, 142 of the notch 14, and the sealing ridges 1413, 1423 generating localised positive pressure on the skin P.

In the context of the second aspect of the invention, although in the exemplary embodiment illustrated the through-cavity of the stencil is in the form of a cavity with an open contour, in the form of a notch, the border of which is formed of the first and second segments, it is possible without departing from the context of the invention to conceive of employing a sealing rim on the border of a through-cavity of some other form, and for example with a closed contour, such as a cavity with a circular, oblong, ovoid, or else polygonal contour, or with an open contour, such as a cavity whose contour follows a polygonal, rounded, for example crescent moon-shaped, rugby ball-shaped, wavy or other form.

According to one advantageous provision of the invention, especially according to its first and second aspects, and in particular according to its first aspect, the positioning edge 130 of the main body 10 of the stencil 1 is configured to be placed parallel to the midline M of the face, as illustrated in particular in FIG. 5A.

This placement of the positioning edge 130 parallel to the midline M of the face is particularly easy and intuitive for the user, the triangular shape of the stencil further reinforcing the intuitive use of the stencil.

The positioning edge 130, or at least the portion thereof which extends between the first end of the first segment 141 of the notch 14 and the angle 101, advantageously has a length L measured along the positioning axis X of greater than or equal to 15 mm, especially greater than or equal to 20 mm, preferably greater than or equal to 25 mm, for example close to 35 mm. Such a minimum length of the positioning edge 130 enables the user to reliably and precisely position the stencil 1 by placing this positioning edge 130 parallel to the midline M of the face.

Moreover, and as can be seen in particular in FIGS. 2 and 5A to 5C, the first segment 141 of the notch 14 forms an angle $\alpha$ of between 95° and 145°, preferably of between 110° and 130°, with the positioning edge 130. In the exemplary embodiment illustrated, the angle $\alpha$ between the first segment 141 of the notch 14 and the positioning edge is between 110° and 130°, being close to 120°.

By virtue of these provisions, which are particularly advantageous in the context of an application of eyeliner in order to form a wing at the outer corner of an eye to be made up, when the user applies the stencil against his skin, for example via the first front face 11 of the main body 10, close to the outer corner of the eye, orients the positioning edge 130 parallel to the midline M of the face, with the first segment 141 of the notch 14 extending upwards from the positioning edge 130, and places the first end of the first segment 141 of the notch 14 at the outer corner of the eye, the first segment 141 points optimally, considering the variety of existing face shapes, towards the base B of the nose.

"Extending upwards" is intended to mean that the first segment 141 of the notch 14 extends in the direction of the top of the face when the stencil 1 is placed against the skin, with the positioning edge 130 extending parallel to the midline M of the face.

With the stencil thus positioned on his face, when the user draws a line of eyeliner following the first segment 141 of the notch 14, he obtains a wing or at least a rough outline of a wing that is perfectly oriented on his face, in the extension of a virtual line LV going from the base B of the nose to the outer corner of the eye, as recommended by some make up professionals.

As a variant which is not illustrated, it is possible to provide for the angle α between the first segment 141 and the positioning edge 130 to be between 120° and 140°, and in particular close to 130°. Thus, when the user applies the stencil 1 against his skin, for example via the first front face 11 of the main body 10, close to the outer corner of the eye, orients the positioning edge 130 parallel to the midline M of the face, with the first segment 141 of the notch 14 extending upwards from the positioning edge 130, and places the first end of the first segment 141 of the notch 14 at the outer corner of the eye, the first segment 141 points optimally, considering the variety of existing face shapes, towards the wing A of the nose located on the side of the eye to be made up.

With the stencil thus positioned on his face, when the user draws a line of eyeliner following the first segment 141 of the notch 14, he obtains a wing or at least a rough outline of a wing that is perfectly oriented on his face, in the extension of a virtual line going from the wing A of the nose located on the side of the eye to be made up to the outer corner of the eye, as recommended by other makeup professionals. Thus, a wing of eyeliner is obtained at the outer corner of the eye, having an inclination relative to the eyeline that is more inclined than in the exemplary embodiment illustrated in the figures.

Such an orientation of the wing of eyeliner at the outer corner of the eye, obtained by applying the stencil 1 against the skin, for example via the first front face 11 of the main body 10, close to the outer corner of the eye, orienting the positioning edge 130 parallel to the midline M of the face, with the first segment 141 of the notch 14 extending upwards from the positioning edge 130, and placing the first end of the first segment 141 of the notch 14 at the outer corner of the eye, towards the base of the nose or the wing of the nose located on the side of the eye to be made up is particularly advantageous, attractive and pleasing in the context of Caucasian or Asian eyes.

In the case of eyes which are more deeply sunken into the face than Caucasian or Asian eyes, it may be advantageous to move the stencil further outwards relative to the outer corner of the eye to be made up, in a direction perpendicular to the midline M of the face, as can be seen in FIG. 5B'. In this FIG. 5B', the user applies the stencil 1 against his skin, for example via the first front face 11 of the main body 10, close to the outer corner of the eye, orients the positioning edge 130 parallel to the midline M of the face, with the first segment 141 of the notch 14 extending upwards from the positioning edge 130, places the first end of the first segment 141 of the notch 14 at the outer corner of the eye, then moves the stencil 1 outwards from the eye to be made up by a distance O in a direction perpendicular to the midline M of the face.

Moreover, the length l1 of the first segment 141 of the notch 14, measured between its first and second ends, is defined such that, by drawing a line of eyeliner along the whole length l1 of the first segment 141 of the notch 14, a wing V, V' of pleasing and attractive length is obtained. The length l1 of the first segment 141 of the notch 14 is especially between 6 mm and 16 mm, preferably between 8 mm and 14 mm. In the exemplary embodiment illustrated, the length l1 of the first segment 141 of the notch 14 is close to 12 mm.

Preferably, and as is apparent on the exemplary embodiment illustrated, the notch 14 comprises a second segment 142 extending between the first end of the first segment 141 and the positioning edge 130, forming an opening angle β with the first segment 141, so as to define, with said first segment, a space for receiving 140 cosmetic product, and in particular eyeliner, the shape of which corresponds to that of the wing which will be drawn by the user.

When the first and second segments 141, 142 of the notch 14 are rectilinear, the shape defined by the receiving space 140 is triangular, and the wing V, V' drawn by applying the eyeliner in the receiving space 140 is correspondingly triangular in shape, as is apparent in the exemplary embodiment illustrated.

As a variant, the first and second segments 141, 142 of the notch 14 may follow curved axes, for example an arc of a circle, having the same direction of curvature, with identical or different radii, so as to form a receiving space 140 in the shape of a quarter moon, or having opposite directions of curvature so as to form a receiving space 140 in the shape of a rugby ball. When the axis, along which the first segment 141 of the notch 14 extends, forms, with its first end, an angle α as defined previously with the positioning edge 130, the wing of eyeliner drawn by applying eyeliner into the receiving space 140 will be optimally oriented on the face.

The length l2 of the second segment 142 of the notch 14, measured between its first and second ends, is defined such that, by applying eyeliner in the whole receiving space 140 defined by the first and second segments 141, 142 of the notch 14, a wing V, V' of pleasing and attractive shape is obtained. The length 12 of the second segment 141 of the notch 14 is especially between 6 mm and 14 mm, preferably between 8 mm and 12 mm. In the exemplary embodiment illustrated, the length l1 of the first segment 141 of the notch 14 is close to 10 mm.

As can clearly be seen in FIG. 5A, in which a wing V' of eyeliner has already been produced by means of the stencil 1 according to the invention at the outer corner of the right eye of a user (the stencil 1 is represented in dashed lines at the right eye of the user) and in which the user has positioned the stencil 1 according to the invention at the outer corner of his left eye in order to draw a wing of eyeliner there (the stencil is represented in solid lines at the left eye of the user), by virtue of the stencil 1 especially according to the first aspect of the invention, wings V, V' are obtained at the outer corners of the right and left eyes of a user which have clearly-defined and precise contours of a pleasing and attractive shape on the face, and which have improved symmetry relative to the midline M of the face which is repeatable from one application of eyeliner to another on the user's face.

The invention, in particular according to the first aspect or the second aspect, also relates to a process for using a stencil 1, in particular according to these first and second aspect of the invention, in order to apply a cosmetic product in fluid or pulverulent form, in particular a makeup or care product, to the skin P.

In the context of the second aspect of the invention, the process for using the stencil 1 comprises an initial step of positioning the stencil 1 on the region of the skin to which it is desired to apply the cosmetic product.

Thus, the process of using the stencil 1 according to the second aspect of the invention comprises a first step consisting in placing one of the first or the second front face 11, 12 in contact with the skin P, with the through-cavity 14 located level with the region Z of the skin P to which it is desired to apply the cosmetic product.

The user then presses the first or second front face 11, 12 against the skin P such that the sealing rim 1411, 1412; 1421, 1422 locally deforms the skin P along the border 141, 142 of the through-cavity 14;

Finally, the user applies the cosmetic product to the region Z of the skin P to which it is desired to apply the cosmetic product through the receiving space 140, the leaktightness between the skin P and the notch 14 of the stencil 1 being provided by the sealing rim 1411, 1412; 1421, 1422.

More specifically, in the context of the exemplary embodiment illustrated, the stencil 1 is provided to help the user form a wing of eyeliner at the outer corner of the eye.

Thus, in particular in the context of the first and second aspect of the invention, a process for using the stencil 1 according to the first and second aspect of the invention is proposed in order to produce the drawing of a wing V, V' of eyeliner at the outer corner of a first eye to be made up.

In the context of the first and second aspects of the invention, the process for using the stencil 1 comprises an initial step of positioning the stencil 1 at the outer corner of the eye to which it is desired to apply a wing of eyeliner.

Thus, the process for using the stencil 1 according to the first and second aspect of the invention comprises a first step consisting in placing one of the first or the second front face 11, 12 in contact with the face, close to the outer corner of the first eye to be made up. In the exemplary embodiment illustrated, the aim is to produce the wing V at the outer corner of the user's left eye, since the wing of the right eye V' has already been produced, as can be seen in particular in FIGS. 5A to 5E. Thus, in this exemplary embodiment illustrated, in order to produce the wing V at the outer corner of the user's left eye, the stencil is brought into contact with the user's face via its first front face 11.

The user then positions the positioning edge 130 parallel to the midline M of the face, with the first segment 141 of the notch 14 extending upwards from said positioning edge 130, as can be seen in particular in FIG. 5A.

"Extending upwards" is intended to mean that the first segment 141 of the notch 14 extends in the direction of the top of the face when the stencil 1 is placed against the skin, with the positioning edge 130 extending parallel to the midline M of the face.

The user subsequently places the first end of the first segment 141 of the notch 14 connected to the positioning edge 130 at the outer corner of the first eye to be made up, in this instance the left eye, as can be seen in particular in FIG. 5B.

As a variant, and as described above, in the case of eyes which are more deeply sunken into the face than Caucasian or Asian eyes, the user advantageously moves the stencil 1 further outwards relative to the outer corner of the eye to be made up, in this instance the left eye, in a direction perpendicular to the midline M of the face, as can be seen in FIG. 5B'. In this FIG. 5B', the user applies the stencil 1 against his skin, for example via the first front face 11 of the main body 10, close to the outer corner of the left eye, orients the positioning edge 130 parallel to the midline M of the face, with the first segment 141 of the notch 14 extending upwards from the positioning edge 130, places the first end of the first segment 141 of the notch 14 at the outer corner of the left eye, then moves the stencil 1 outwards from the left eye by a distance O in a direction perpendicular to the midline M of the face. Advantageously, this distance O is between 1 mm and 8 mm, preferably between 3 mm and 6 mm. In the exemplary embodiment illustrated in FIG. 5B', the distance O is close to 4.5 mm.

Finally, and as can be seen in particular in FIG. 5C, the user draws a wing V of eyeliner at the outer corner of the left eye, following the first segment 141 of the notch 14, by means of an applicator tip 31.

More precisely, in the exemplary embodiment illustrated and as described above, the notch 14 of the stencil 1 also comprises a second segment 142 and has a receiving space 140 with a contour which is substantially triangular in shape, defined by the first and second segments 141, 142 of the notch 14 and by the positioning edge 130.

Thus, the step of drawing a wing V of eyeliner at the outer corner of the eye consists in filling this receiving space 140 with a triangular contour by drawing a first line of eyeliner along the first segment 141, drawing a second line along the second segment 142, and filling the remainder of the receiving space 140 between these first and second lines, so as to form a wing V which is triangular in shape, the shape of which corresponds to that of the receiving space 140 defined by the notch 14.

Thus, a wing V of eyeliner is obtained at the outer corner of the left eye which has a clearly defined and precise contour, is pleasingly and attractively oriented on the face, and is repeatable from one application of eyeliner to another.

According to an advantageous provision of the process for using the stencil 1 according to the first or second aspect of the invention, it is possible to use the process in order to produce the drawing of a wing V' of eyeliner at the outer corner of a second eye to be made up, in this instance the right eye.

Thus, the process for using the stencil 1 according to the first or second aspect of the invention comprises a step consisting in placing the other of the first or the second front face 11, 12 in contact with the face, in this instance the second front face 12, close to the outer corner of the second eye to be made up, in this instance the right eye, as can be seen in dashed lines in FIG. 5A.

The user then positions the positioning edge 130 parallel to the midline M of the face, with the first segment 141 of the notch 14 extending upwards from said positioning edge 130.

"Extending upwards" is intended to mean that the first segment 141 of the notch 14 extends in the direction of the top of the face when the stencil 1 is placed against the skin, with the positioning edge 130 extending parallel to the midline M of the face.

The user subsequently places the first end of the first segment 141 of the notch 14 connected to the positioning edge 130 at the outer corner of the second eye to be made up, in this instance the right eye, then they draw a wing V' of eyeliner at the outer corner of the second eye to be made up, in this instance the right eye, following the first segment 141 of the notch 14.

By virtue of these provisions, it is possible to readily obtain wings V, V' of eyeliner at the outer corners of the eyes which are symmetrical relative to the midline M of the face, these wings V, V' having a clearly-defined and precise contour, a pleasing and attractive orientation on the face and being repeatable from one application of eyeliner to another.

As can clearly be seen in FIG. 6, when the user presses the stencil against the skin P, via its first or second front face 11, 12, the sealing rims 1411, 1412; 1421; 1422, and the respective sealing ridges 1413, 1414; 1423; 1424 thereof, locally deform the skin P so as to provide good leaktightness between the skin P and the border of the notch 14 defined by the first and second segments 141, 142. This thereby avoids the eyeliner applied in the receiving space 140 of the notch 14 from bleeding, seeping between the skin P and the first or second front face 11, 12 of the stencil 1 brought into contact with the face.

According to an advantageous provision of the stencil according to the first, second and/or third aspect of the invention, the stencil 1 is made of plastic material, especially of thermoplastic material, such as polypropylene (PP), polyethylene (PE), polyethylene terephthalate (PET), acrylonitrile butadiene styrene (ABS), polybutylene terephthalate (PBT), polyvinyl chloride (PVC), polytetrafluoroethylene (PTFE).

Preferably, the stencil 1 is made of polycyclohexylenedimethylene terephthalate (PCTA).

The plastic material from which the stencil is formed preferably has a Young's modulus of between 0.5 MPa and 5 MPa, preferably of between 0.7 MPa and 3 MPa.

Preferably, the plastic material from which the stencil 1 is formed preferably has a Young's modulus close to 1.3 MPa.

As a variant, the stencil 1 according to the first, second and/or third aspect of the invention is made of metal material, such as brass, steel, aluminium, copper, iron, zamak, etc.

The stencil 1 according to the first, second and/or third aspect of the invention, when it is made of plastic material, is advantageously produced by moulding, and in particular by injection moulding. As a variance, the stencil may be obtained by extrusion of sheets of plastic material which are superposed and attached to one another, then by cutting in order to give the stencil 1 its outer form. In another variance, it is possible to provide for producing the stencil by a technique of 3D printing, such as a fused filament fabrication, additive synthesis, powder sintering or other technique.

The stencil 1 according to the first, second and/or third aspect of the invention, when it is made of metal material, is advantageously cut from a metal sheet, for example by waterjet cutting, chemical cutting, laser cutting or other. The sharp ridges or angles present on the stencil made of metal material may be rounded by a subsequent machining, polishing or other operation.

The invention according to the first, second or third aspect also relates to an assembly, represented in FIGS. 7 to 10, comprising a cap 2 suitable for closing a container 3 of cosmetic product, said cap extending along a longitudinal axis Z, and an accessory 1 for the application of said cosmetic product, said accessory comprising a substantially planar main body 10.

As described previously, in the illustrated embodiment, the accessory 1 according to the third aspect of the invention is a stencil 1 suitable for the application of eyeliner in order to form a wing V, V' at the outer corner of an eye to be made up.

Thus, and as can be seen in these FIGS. 7 to 10, the stencil 1 can move between a stowed configuration in which it is secured to the cap 2 and a use configuration in which it is detached from the cap 2.

According to an advantageous provision, especially in the context of the third aspect of the invention, and as is apparent in particular in FIGS. 7 to 9, the cap 2 comprises a receiving groove 200 extending parallel to the longitudinal axis Z of the cap 2.

This groove 200 of the cap 2 is suitable for receiving at least one portion of the accessory, and in this instance the stencil 1, forming a rail in the stowed configuration of the accessory, which stowed configuration is illustrated for example in FIGS. 9 and 10E.

Moreover, and as can be seen in FIGS. 10A to 10E, the assembly according to the first, second and/or third aspect of the invention also advantageously comprises a container 3 of cosmetic product.

In the exemplary embodiment illustrated, this container 3 is a reservoir of eyeliner.

Advantageously, and as illustrated in these FIGS. 10A to 10E, the container 3 of eyeliner is in the form of an eyeliner pen comprising a reservoir 30 of eyeliner and an applicator tip 31, especially made of porous and/or fibrous material, such as felt, and in fluid communication with the reservoir 30. The applicator tip 31 is thus supplied with eyeliner by capillary action from the reservoir 30 of eyeliner.

As a variant, not illustrated, the container of eyeliner may be in the form of a bottle and the cap 2 may belong to a submerged applicator comprising a rod, one end of which is connected to the cap 2 and the opposite end of which is provided with an applicator member suitable for being submerged inside the bottle which forms a reservoir of eyeliner, in order to be loaded with eyeliner.

Advantageously, and as illustrated in particular in FIG. 7, the cap 2 has an outer peripheral surface 20 comprising two wings 21, 22 facing one another extending parallel to the longitudinal axis Z of the cap 2.

These two wings 21, 22 together define the receiving groove 200 of the stencil 1.

As is apparent in particular in FIGS. 7 to 8, the receiving groove 200 extends between a first end 201 which is open in the direction of the longitudinal axis Z of the cap 2 and a second opposite end 202.

The second end 202 of the receiving groove 200 is provided with a stop 203 for stopping the stencil 1 in the direction of the longitudinal axis Z of the cap 2.

Advantageously, the portion of the accessory, and in this instance of the stencil 1 that forms a rail, suitable for being received in the receiving groove 200 of the cap 2 in the stowed configuration of the stencil 1, comprises the positioning edge 130.

As a variant, not illustrated, it is possible to provide for the portion of the stencil that forms a rail to be constituted by a rail, the cross-section of which is complementary in form to that of the cross-section of the receiving groove, and connected to, or made in one piece with one of the front faces 11, 12 of the stencil 1.

Moreover, and as can be seen in particular in FIGS. 1, 2, 4 and 4A, the main body 10 of the stencil 1, and more particularly the front faces 11, 12 thereof each have a guide groove 110, 120 extending parallel to the positioning edge 130, set back therefrom in the direction perpendicular to the positioning axis X.

The receiving groove 200, and more precisely each of the wings 21, 22 defining the receiving groove 200, has one, and in this instance two, guide clusters 210, 220, protruding inside the receiving groove 200. The guide clusters 210, 220 extend on the facing faces of the wings 21, 22 defining the receiving groove 200.

Thus, the guide grooves 110, 120 provided on the stencil 1 cooperate with the guide clusters 210, 220 provided in the receiving groove 200 of the cap 2 in order to guide the stencil 1 between its stowed configuration and its use configuration and vice versa, and in order to block the stencil 1 relative to the cap 2 in the direction perpendicular to the longitudinal axis Z of the cap 2.

Figure 4:
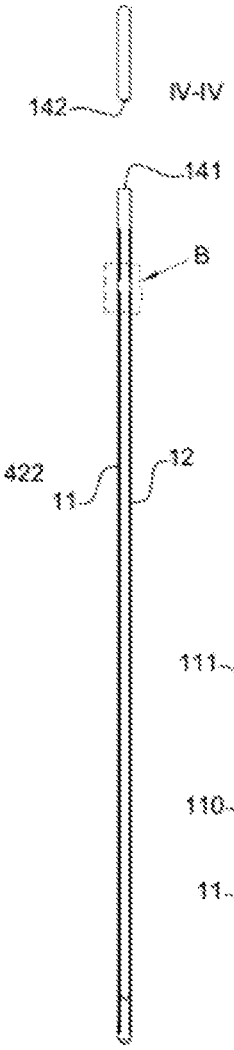
FIG. 4 is a view in cross section along the line IV-IV of the stencil of FIG. 2.
Figure 4A:
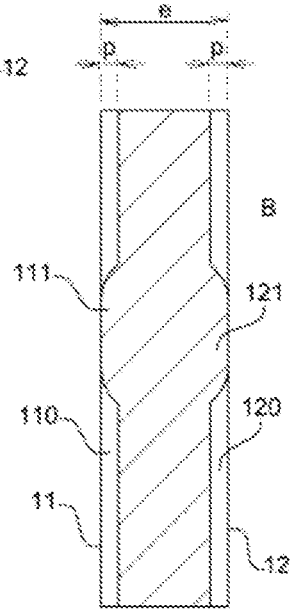
FIG. 4A is an enlarged view of the detail B of FIG. 4.

Moreover, and as can be seen in particular in FIGS. 4 and 4A, the guide grooves 110, 120 provided on the stencil 1 also comprise a blocking protrusion 111, 121 protruding inside each guide groove 110, 120.

As can be seen in particular in FIG. 4A, the blocking protrusions 111, 121 are substantially flush with the first and second front faces 11, 12 of the stencil.

Moreover, still in relation to FIG. 4A, in the embodiment illustrated, the guide grooves 110, 120 have a groove depth p of the order of 0.075 mm, for a thickness e of the stencil (distance between the front faces 11 and 12) of 0.55 mm.

More generally, the depth p of the guide grooves 110, 120 may for example be between 0.05 mm and 0.15 mm.

Preferably, the depth p of the guide grooves 110, 120 may for example be between 10% and 25%, in particular close to 12.5%, of the distance e separating the first and second front faces 11, 12 of the stencil 1, or the thickness of the stencil 1.

The receiving groove 200, and more precisely each of the wings 21, 22 defining the receiving groove 200, has a blocking stud 211, 221, protruding inside the receiving groove 200. The blocking studs 211, 221 extend on the facing faces of the wings 21, 22 defining the receiving groove 200.

Thus, the blocking protrusions 111, 121 provided in the guide grooves 110, 120 of the stencil 1 cooperate with the blocking studs 211, 221 to block the stencil 1 in the stowed configuration relative to the cap 2 along the longitudinal axis Z, on the side of the first open end 201 in the direction of the longitudinal axis Z of the receiving groove 200.

According to an advantageous provision, the cap 2 is made of plastic material, especially of thermoplastic material, such as polypropylene (PP), polyethylene (PE), polyethylene terephthalate (PET), acrylonitrile butadiene styrene (ABS), polybutylene terephthalate (PBT), polyvinyl chloride (PVC), polytetrafluoroethylene (PTFE).

Preferably, the cap 2 is made of polycyclohexylenedimethylene terephthalate (PCTA).

The plastic material from which the cap 2 is formed preferably has a Young's modulus of between 0.5 MPa and 5 MPa, preferably of between 0.7 MPa and 3 MPa.

Preferably, the plastic material from which the cap 2 is formed preferably has a Young's modulus close to 1.3 MPa.

According to a particularly advantageous provision, the stencil is made of PCTA and the cap is made of PCTA. By virtue of these provisions, the passage of the stencil between its stowed configuration and its use configuration relative to the cap, and vice versa, advantageously responds to a problem of compromise between reliable and durable holding in the stowed position of the stencil 1 on the cap 2 and makes it easier for the user to move the stencil from its stowed configuration to its use configuration relative to the cap, and vice versa.

FIGS. 10A to 10E illustrate the sequence of passage of the stencil 1 from its use configuration to its stowed configuration relative to the cap 2 after a user has used the stencil 1 to draw, by means of the applicator tip 31, wings V, V' at the outer corners of his eyes as described above. For the purposes of clarity, the guide grooves 110, 120 of the stencil 1 have not been depicted in these FIGS. 10A to 10E.

As illustrated in FIG. 10A, the user, after an application of eyeliner, has the container 3 of eyeliner comprising, as described previously, a reservoir of eyeliner 30 and an applicator tip 31. In the exemplary embodiment illustrated, the reservoir of eyeliner 30 and the applicator tip 31 both extend along a longitudinal axis Y.

As illustrated in FIG. 10B, the user begins by re-closing the container 3 of eyeliner using the cap 2, by lining up the longitudinal axis Z of the cap 2 with the longitudinal axis Y of the container 3.

In a known way, the container 3 and the cap 2 are provided with additional fixing elements suitable for cooperating in order to removably hold the cap 2 on the container 3. Such additional elements may advantageously take the form of an external/internal thread system or a snap-fastening system, for example.

The user then brings the stencil 1 close to the receiving groove 200 of the cap 2, as illustrated in FIG. 10C.

The user then inserts the lower angle 101 of the stencil 1 through the first end 201 of the receiving groove 200 and orients the stencil 1 such that its positioning axis X extends parallel to the longitudinal axes Y, Z of the container 3 and of the cap 2.

The user then slides the stencil 1 along the receiving groove 200 of the cap, the guide clusters 210, 220 of the receiving groove 200 of the cap 2 cooperating with the guide grooves 110, 120 of the stencil 1 until the lower angle 101 butts up against the stop 203 of the receiving groove 200.

Concomitantly to the abutment of the lower angle 101 of the stencil 1 against the stop 203 of the receiving groove 200, the blocking studs 211, 221 of the receiving groove 200 of the cap 2 pass the blocking protrusions 111, 121 provided in the guide grooves 110, 120 of the stencil 1 so as to immobilise the stencil 1 relative to the cap 2 along the longitudinal axis Z of the cap 2 on the side of the first end 201 of the receiving groove 200 open in the direction of the longitudinal axis Z.

Such a passage of the stencil 1 from its use configuration to its stowed configuration on the cap 2 by simple translation parallel to the longitudinal axis Z of the cap 2 is particularly intuitive, easy and fun for the user, in particular due to the general flattened triangular shape of the stencil 1.

However, as a variant and as can be seen in FIG. 10D, in order to give more freedom to the user for stowing the stencil 1 on the cap 2, the passage of the stencil 1 from its use configuration to its stowed configuration on the cap 2 may also be carried out by a combined movement of translation parallel to the longitudinal axis Z of the cap 2 and by rotation about an axis perpendicular to the wings 21, 22 defining the receiving groove 200, the system of guide clusters 210, 220 and of blocking stud 211, 212 of the receiving groove 200 making it possible to allow snap-fastening of the guide groove 110, 120 of the stencil 1 in the receiving groove 200 by a movement of translation or of combined translation/rotation, this movement comprising a component oriented parallel to the wings 21, 22 defining the receiving groove 200.

The invention claimed is:

1. A stencil suitable for the application of eyeliner in order to form a wing (V, V') of eyeliner at the outer corner of an eye, said stencil comprising a substantially planar main body and having:

a first front face;

a second front face opposite the first front face;

a lateral edge portion connecting the first and second front faces and comprising a positioning edge;

wherein the positioning edge is substantially rectilinear extending greater than or equal to 15 mm along a positioning axis (X) and comprises a notch opening onto the first and second front faces and onto the positioning edge and defining a receiving space for the eyeliner, said notch comprising a first segment having a first end connected to the positioning edge and a second opposite end, in that the positioning edge is configured to be placed parallel to a midline (M) of the face, and in that the first segment forms, with the positioning edge, an angle (α) of between 95° and 145°.

2. The stencil according to claim 1, wherein the notch comprises a second segment having a first end connected to the positioning edge and a second opposite end connected to the second end of the first segment, and wherein the first end of the first segment and the first end of the second segment are separated by a distance (d) measured along the positioning axis (X), said distance (d) being between 3 mm and 6 mm.

3. The stencil according to claim 2, wherein the first segment and/or the second segment of the notch is/are substantially rectilinear.

4. The stencil according to claim 2, wherein the second segment forms, with the first segment, an angle (β) of between 5° and 35°.

5. The stencil according to claim 1, wherein the lateral edge portion has a triangular contour.

6. The stencil according to claim 1, wherein said stencil is made of plastic material selected from the group consisting of polypropylene (PP), polyethylene (PE), polyethylene terephthalate (PET), acrylonitrile butadiene styrene (ABS), polybutylene terephthalate (PBT), polyvinyl chloride (PVC), polytetrafluoroethylene (PTFE), and polycyclohexylenedimethylene terephthalate (PCTA), having a Young's modulus of between 0.5 MPa and 5 MPa.

7. The stencil according to claim 1, wherein the first segment and/or the second segment of the notch has a sealing rim protruding from the first front face and/or from the second front face of the main body, by a protrusion distance (s) of between 20% and 40% of the distance (e) separating the first and second front faces, said protrusion distance (s) being between 0.1 mm and 0.3 mm, said sealing rim being configured to be placed in contact with the skin (P), so as to locally deform the skin (P) along the first segment and/or the second segment of the notch.

8. The stencil according to claim 7, wherein the sealing rim has a triangular cross section so as to form a sealing ridge configured to be placed in contact with the skin (P), so as to locally deform the skin (P) along the first and the second segments of the notch.

9. A process for using the stencil according to claim 1 to produce the drawing of a wing (V, V') of eyeliner at the outer corner of a first eye to be made up, comprising:

placing one of the first or the second front face in contact with the face, adjacent to the outer corner of the first eye to be made up;

positioning the positioning edge parallel to the midline (M) of the face, with the first segment of the notch extending upwards from said positioning edge;

placing the first end of the first segment of the notch connected to the positioning edge at the outer corner of the first eye to be made up;

drawing a wing (V, V') of eyeliner at the outer corner of the first eye to be made up, following the first segment of the notch.

10. The process according to claim 9, for producing the drawing of a wing (V, V') of eyeliner at the outer corner of a second eye to be made up, comprising:

placing the other of the first or the second front face in contact with the face, adjacent to the outer corner of the second eye to be made up;

positioning the positioning edge parallel to the midline (M) of the face, with the first segment of the notch extending upwards from said positioning edge;

placing the first end of the first segment of the notch connected to the positioning edge at the outer corner of the second eye to be made up;

drawing a wing (V, V') of eyeliner at the outer corner of the second eye to be made up, following the first segment of the notch.

11. The process according to claim 10 further comprising filling the receiving space of the notch defined by the first and second segments and by the positioning edge with eyeliner, so as to form a wing (V, V') of eyeliner at the outer corner of the first and/or second eye to be made up, the shape of which corresponds to the shape of the receiving space of the notch.

12. An assembly comprising:

a stencil according to claim 1, and a cap suitable for closing a container of eyeliner and extending along a longitudinal axis (Z);

wherein the stencil can move between a stowed configuration in which it is secured to the cap and a use configuration in which it is detached from the cap.

13. The assembly according to claim 12, wherein the cap comprises a receiving groove extending parallel to the longitudinal axis (Z) and suitable for receiving at least a portion of the stencil forming a rail in the stowed configuration of the stencil.

14. The assembly according to claim 12 further comprising a container of eyeliner comprising a reservoir of eyeliner and an applicator tip in fluid communication with the reservoir.

* * * * *